United States Patent [19]

Lindsey, Jr.

[11] Patent Number: 4,497,371

[45] Date of Patent: Feb. 5, 1985

[54] SETTING TOOL AND RETRIEVABLE LANDING ASSEMBLY

[75] Inventor: Hiram E. Lindsey, Jr., Midland, Tex.

[73] Assignee: MWL Tool and Supply Company, Midland, Tex.

[21] Appl. No.: 274,170

[22] Filed: Jun. 16, 1981

[51] Int. Cl.[3] ..... E21B 23/04

[52] U.S. Cl. ..... 166/377; 166/208; 166/212; 166/217; 166/382

[58] Field of Search ..... 166/208, 212, 120, 131, 166/122-125, 181, 184, 217, 377, 138, 139, 117, 332, 318, 382

[56] References Cited

U.S. PATENT DOCUMENTS

| | | | |
|---|---|---|---|
| 3,713,490 | 1/1973 | Watson | 166/305 |
| 3,933,202 | 1/1976 | Ahlstone | 166/208 |
| 3,934,652 | 1/1976 | Cochran | 166/208 |
| 4,059,150 | 11/1977 | Manderscheid | 166/212 |
| 4,171,018 | 10/1979 | Walker | 166/208 |
| 4,287,949 | 9/1981 | Lindsey, Jr. | 166/212 |

*Primary Examiner*—James A. Leppink
*Assistant Examiner*—Hoang C. Dang

[57] ABSTRACT

Apparatus and method of positioning and seating a retrievable landing assembly within a packer bore receptacle in a well bore. Latching measure provided for releasably securing a landing assembly in the packer bore receptacle. The latching means which are normally in a retracted position are actuated by hydraulic pressure means to lock the landing assembly within the packer bore receptacle. The retrievable landing assembly can be retrieved with a spear mechanism by shearing a release mechanism. The retrievable landing assembly is hydraulically set and mechanically retrieved.

18 Claims, 18 Drawing Figures

FIG. 5
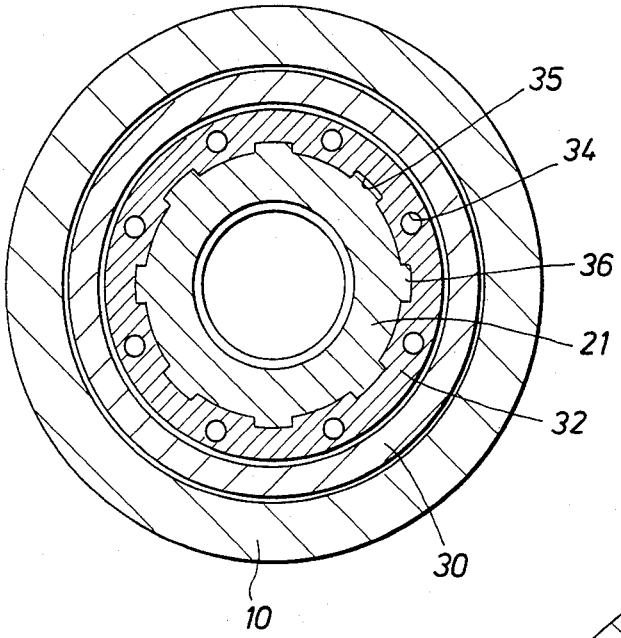
FIG. 7
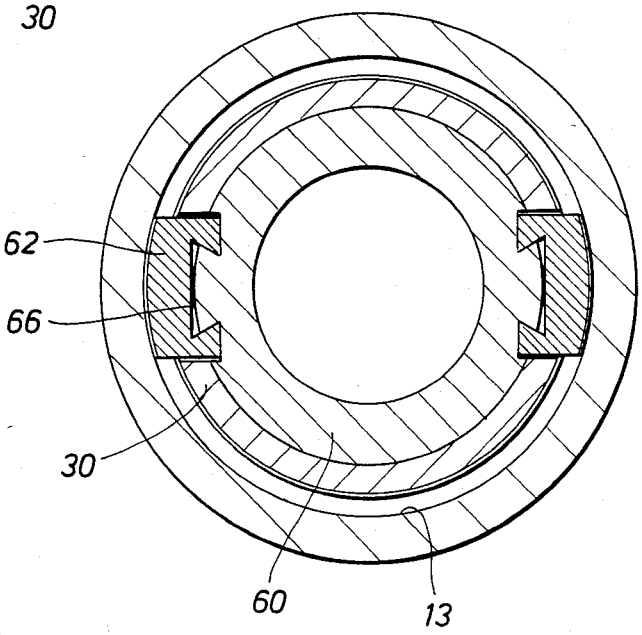
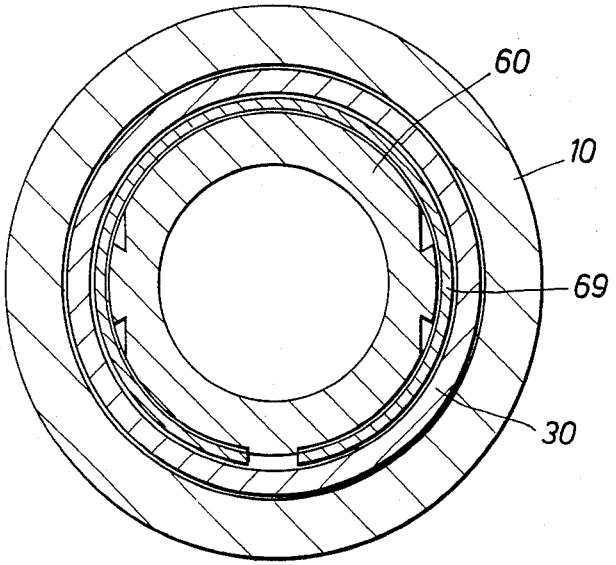
FIG. 6

SETTING TOOL AND RETRIEVABLE LANDING ASSEMBLY

FIELD OF THE INVENTION

This invention relates to oil well production tools for oil wells and more particularly, to a retrievable landing assembly for use in a packer bore receptacle system.

DESCRIPTION OF THE PRIOR ART

Packer bore receptacle systems (or "PBR" systems) are typically employed on top of a production liner in conjunction with a liner hanger disposed in a well bore. A PBR typically has a long polished bore which slidably and sealingly receives a sealing assembly on the end of a tubing string. Thus, during production the tubing end is free to move a calculated distance by expansion or contraction while maintaining a fluid tight seal in the tubing.

A retrievable landing device is intended for use within a PBR and permits use of smaller size tubing or plugging for remedial work. The retrievable landing device typically uses a multiple latching elements to latch the device into a pre-cut locking groove in the PBR.

Heretofor, a retrievable landing device has been mechanically set, after inserting the device in the well bore and after it contacts a no-go shoulder. Setting is accomplished by setting down weight on the device to force a shear pin to release and to set the latch or lug means in the pre-cut latching groove in the packer bore receptacle. The energy for setting the latch or lug means in the latching groove comes from a compressed spring in the tool. A system of this type is illustrated in the 1980–81 Composite Catalog of Oilfield Equipment & Service, 34th Revision on page 6863.

For a number of reasons these mechanical devices have problems which include failure of the setting mechanism to operate downhole for one reason or another and inability to set or retrieve the device easily. In addition, with mechanically operated devices which are shear pin released, they are subject to premature setting whenever the tool hits an obstruction or shoulder while going into the hole.

With respect to the type of equipment described, these problems are overcome by the present invention by providing a hydraulically operated setting mechanism for a landing device which is used in a PBR. The setting mechanism is positively operated and the latch or lug means are positively set in the PBR latching groove. In one embodiment of the invention, the latches can be positively retracted.

Accordingly, it is an object of the present invention to provide a method for setting production tools and apparatus for a retrievable landing assembly which is hydraulically operated.

DESCRIPTION OF THE INVENTION

The present invention includes a retrievable landing tool which is insertable through a string of pipe or tubing in a well bore and which seats in the bore of the production string, usually a polished bore receptacle (PBR). When seated in the bore, a sealing ball is dropped through the tubing and hydraulic pressure is applied to the tubing string. The sealing ball which seats in the landing tool applies a hydraulic pressure to a setting sleeve to cause a shear pin in the landing tool to sever. The pressure applied to the tubular setting sleeve shifts the setting sleeve longitudinally relative to a tubular setting collar and positively projects radially moveable latching elements in the setting collar into engagement with a latching groove in the packer bore receptacle. The setting collar and setting sleeve are telescopically and releasably locked relative to one another by a ratchet system while the latching elements are in an extended position.

The setting tool is released from the setting collar by right hand rotation so that an interconnecting traveling nut on the setting tool disconnects from the setting collar. Thereafter, the setting tool can be retrieved leaving the landing assembly in the packer bore receptacle.

The retrievable landing assembly can be retrievable by means of a conventional spear. The spear engages the setting sleeve to pull it upwardly and shear a coupling or the ratchet between the setting collar and setting sleeve. Once the ratchet means are released or the setting sleeve is uncoupled, further upward movement of the setting sleeve allows the latching elements to retract from the latching groove in the packer bore receptacle. Thereafter the retrievable landing assembly can be retrieved from the packer bore receptacle. Two different types of locking means are disclosed.

In a preferred embodiment, the tool has a valve so that a pressure build-up test can be obtained before dropping the sealing ball. The pressure buildup is a positive indication that the landing device is properly seated in the PBR. Thereafter, right hand rotation serves to open the valve so that fluid may be displaced through the tool during the setting operation.

In one embodiment, retraction of the latching elements is positively controlled by movement of the setting collar.

DESCRIPTION OF DRAWINGS

FIG. 5 is a view in cross-section taken along line 5—5 of FIG. 1A;

FIG. 6 is a view taken line 6—6 of FIG. 2B;

FIG. 7 is a view in cross-section taken along line 7—7 of FIG. 2B;

A DESCRIPTION OF THE PREFERRED EMBODIMENT

The drawings do not illustrate the well bore but it will be understood by those skilled in the art that a "PBR" or Packer Bore Receptacle 10 as referred to herein is disposed in a well bore traversing earth formations and is connected by a string of tubing to the surface of the earth.

Figure 1A:
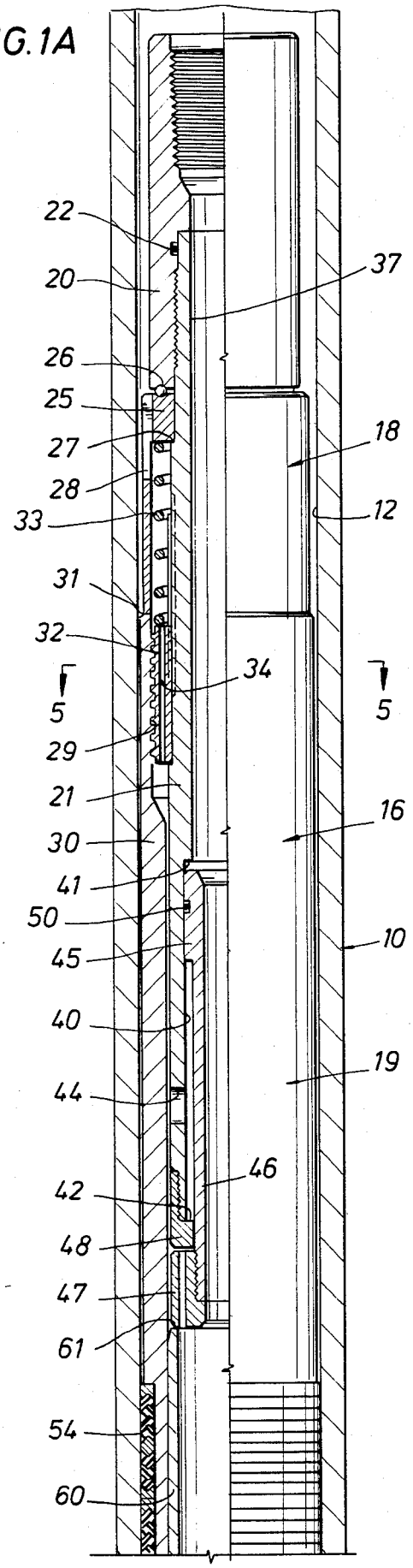
FIGS. 1A and 1B are views in longitudinal cross-section thru a retrievable landing assembly within a packer bore receptacle shown in a position immediately prior to the time that hydraulic pressure is applied to lock the landing assembly in position in the packer bore receptacle.
Figure 1B:
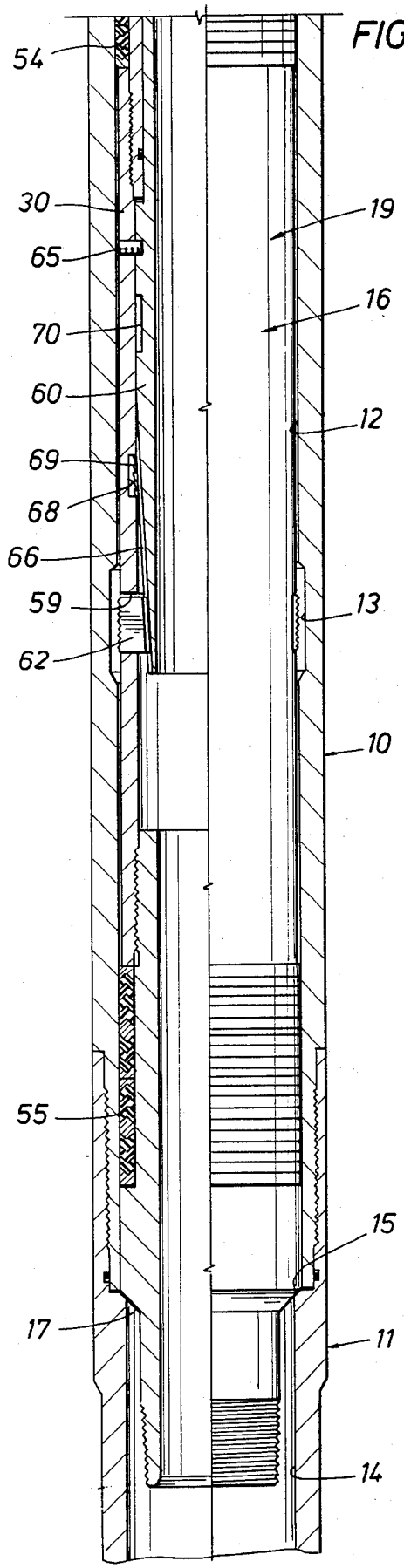

Referring now to FIGS. 1A and 1B, a Packer Bore Receptacle ("PBR") 10 is threadably and sealingly connected at its lower end to a PBR Sub 11 which, in turn, is threadably connected to a conventional liner hanger (not shown). The PBR 10 is tubular with a uniform internal bore 12 along its length. Near the lower end of the internal bore 12 (FIG. 1B) is an annular latching groove or recess 13. The PBR sub 11 has an annular bore 14 which is smaller in diameter than bore 12 and the bores 12 and 14 are joined by a conical, upwardly facing surface which defines a landing seat or shoulder 15 where the shoulder 15 is a "No-Go" shoulder. The retrievable landing assembly ("RLA") 16 of the present invention is designed to pass through the bore 12 of the PBR 10 until a lower, downwardly facing, shoulder 17 on the nose of the RLA 16 engages the landing seat 15 in the PBR sub 11. The Retrievable Landing Assembly 16 includes a hydraulic setting unit 18 which is releasably attached to the retrievable latching unit 19. The hydraulic setting unit 18 has an upper tubular sub 20 which is threadably and sealingly coupled to a downwardly extending tubular mandrel 21. The mandrel 21 is received within a tubular setting collar 30. An O-ring seal 22 is disposed between the mandrel 21 and sub 20 to provide a fluid tight seal. On the outer, upper end of the tubular mandrel 21 is a rotatably mounted tubular cage member 25. The rotatable mounting for the cage member 25 is provided by an annular ball bearing unit 26 and an upwardly facing shoulder 27 on the mandrel 21. The cage member 25 has fluid pressure relief ports 28 through its side wall to permit passage of fluid. The downwardly facing end of the cage member 25 engages the upwardly facing end of the tubular setting collar 30 on a latching unit 19 at a location designated by the number 31. The tubular setting collar 30 of the latching unit 19, at its upper end, has an interior threaded portion 29, which threadedly engages a traveling nut 32. The traveling nut 32 is longitudinally slidable and non-rotatively mounted on the mandrel 21 of the setting unit 18. In the setting unit 18, a compression spring 33 is disposed between the upper end of the traveling nut 32 and the cage member 25 to assist in assembly by forcing the nut 32 out from within the cage member 25. The traveling nut 32 has longitudinally extending bypass ports 34 as a fluid relief bypass and has internal longitudinally extending splines 35 (See FIG. 5) which engage with external longitudinally extending splines 36 on the outer surface of the mandrel 21. When the mandrel 21 of the setting unit 18 is rotated, the traveling nut 32 will be rotated relative to the setting collar 30 of the latching unit 19 so that it can move longitudinally upward with respect to the mandrel 21. The nut 32 thus serves as a releasable connection between the setting tool unit 18 and the retrievable landing unit 19.

The mandrel 21 has a smooth interior bore 37 at its upper end and has an internal recess 40 along its length, the recess 40 being defined between upper and lower shoulders 41 and 42. The recess 40 is provided with a bypass relief ports 44 for a fluid bypass when the setting tool is retrieved. Slidably received in the internal recess 40 is a an outwardly entending flange 45 on a pressure sleeve 46. An O-ring 50 is provided on the flange 45 for sealing the flange 45 with respect to the bore 37 of the mandrel 21. Thus, the pressure sleeve 46 may move downwardly with respect to the mandrel 21 when a sealing ball 52 (FIG. 2A) is dropped down the tubing string and sealed in the cross-sectional opening of the pressure sleeve 46 and when pressure is applied to the tubing. (FIG. 2A).

At the lower end of the pressure sleeve 46 is an outwardly extending flange 47 which has vertical fluid bypass ports. The outwardly entending flange 47 is located below the lower end 48 of the mandrel 21.

The setting collar 30 of the latching unit 19 (which is releasably coupled to the setting unit 18) has an external packing member 54 (FIG. 1A) and packing member 55 (FIG. 1B) for sealing and sliding reception within the polished bore 12 of the PBR 10 when the shoulder 17 is seated on the landing seat 15 (FIG. 1B). A tubular setting sleeve 60 (FIG. 1B) is slidably received within the setting collar 30 and, in an uppermost position, the upper end 61 of the sleeve 60 bears against the lower end of the flange 47 of the setting sleeve 46. Between the upper and lower packing means 54 and 55, when the RLA is seated on the shoulder or seat 15, there are circumferentially spaced openings 59 in the setting collar 30 which are disposed adjacent to the annular locking groove 13 in the PBR 10. Rectangularly shaped latching elements 62 with exterior griping teeth are disposed within the spaced openings 59 so as to move inwardly and outwardly with respect to the setting collar 30 and thus, into and out of the annular latching groove 13 in the PBR 10. The setting sleeve 60 and the setting collar 30 are normally releasably coupled to one another by shear pin means 65. At the lower end of the setting sleeve 60 are tapered surfaces 66 which are circumferentially disposed around the sleeve and are connected by dovetail connections to the latching elements 62. Thus, upon downward movement of the setting sleeve 60 with respect to the setting collar 30, the tapered surfaces 66 wedge the locking elements 62 positively into engagement with the annular locking groove 13 (See FIG. 2B). To retain the setting sleeve 60 in a downward locked position with respect to the locking elements 62, the setting collar 30 is provided with an internal cylindrical recess 68 which carries a split, ratchet ring 69. The ratchet ring 69 is arranged to engage the ratchet recess 70 on the sleeve 60 upon downward movement of the setting sleeve 60, after the shear pin 65 is sheared at a predetermined pressure range. Engagement of the ratchet ring 69 and the ratchet recess 70 prevent return motion of the setting sleeve 60 and keep the latching elements 62 mechanically locked into position (See FIG. 2B).

Figure 2A:
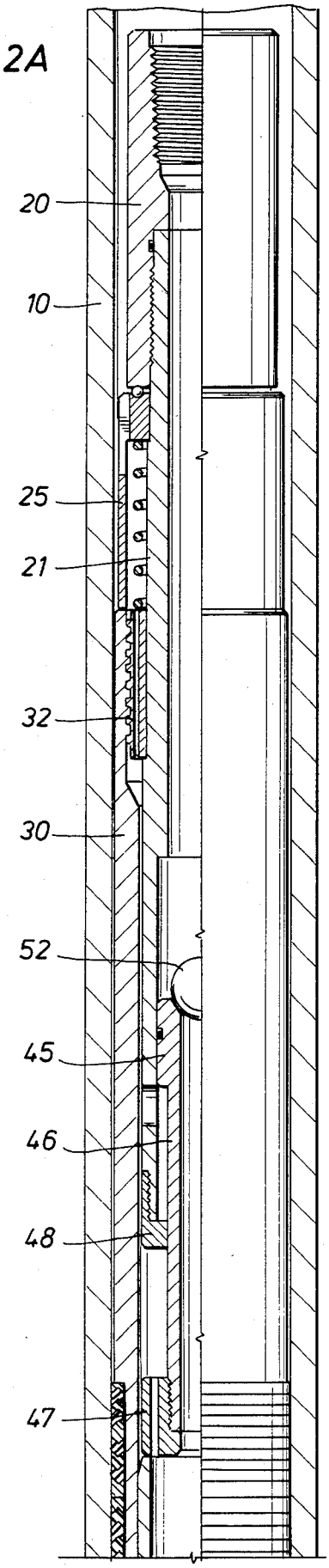
FIGS. 2A and 2B are views in longitudinal cross-section similar to FIGS. 1A and 1B but showing the positional relationship of the retrievable landing assembly after it has been operated by hydraulic pressure to cause the latch means to engage the groove in the packer bore receptacle.
Figure 2B:
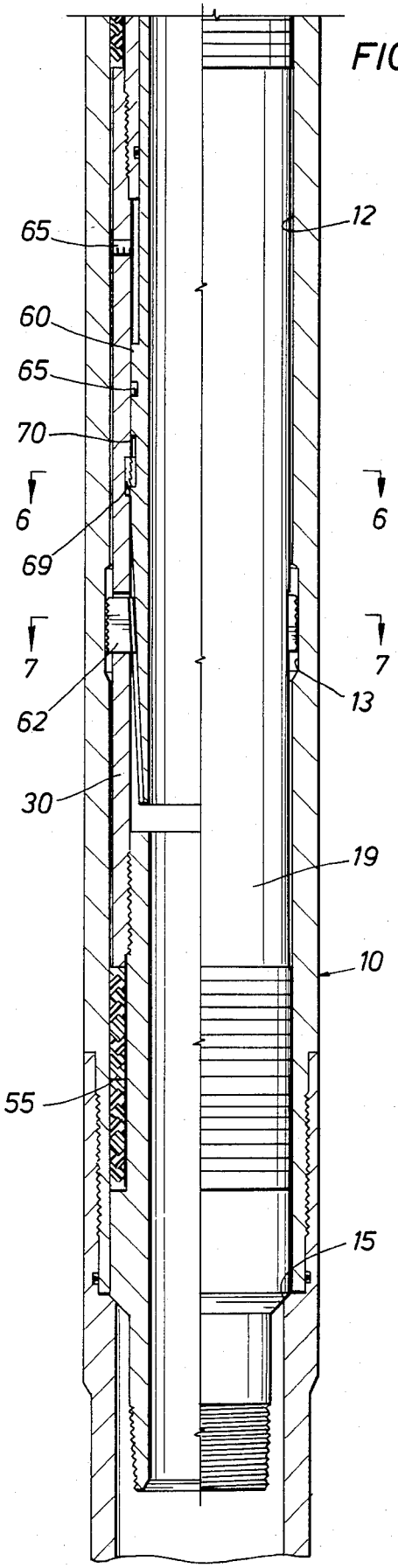

Referring now to FIGS. 2A and 2B, the tool is illustrated in position where the sealing ball 52 is located across the bore of the pressure sleeve 46 so that hydraulic pressure applied within the tubing can move the pressure sleeve 46 downwardly and break the shear pins 65. In the downward movement of pressure sleeve 46, the latching elements 62 are wedged outwardly into engagement with the annular latching groove 13 and the ratchet ring 69 engages the ratchet recess 70 to lock the setting sleeve 60 in its downward position.

Figure 3A:
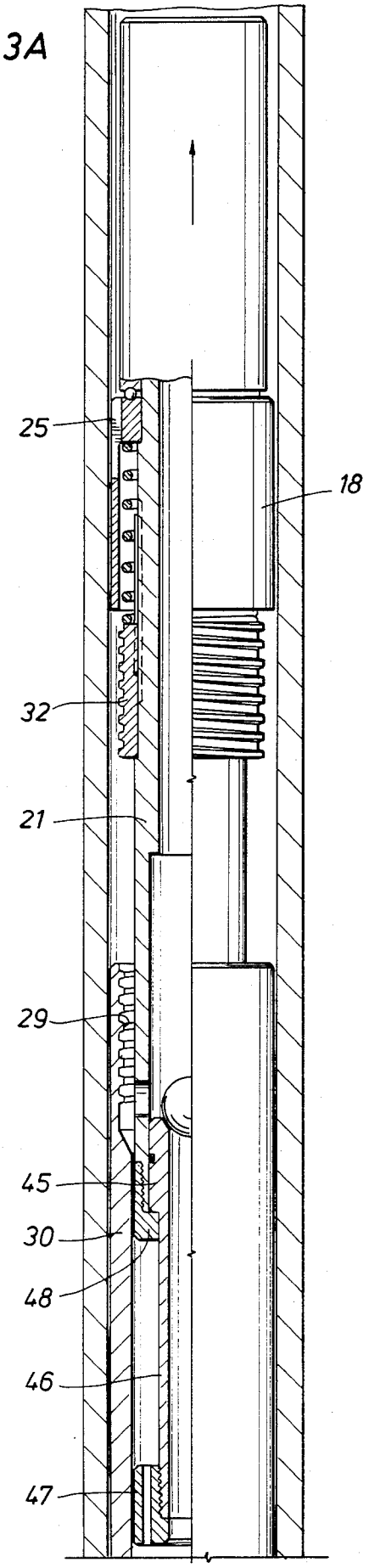
FIGS. 3A and 3B are views in longitudinal cross-section similar to FIGS. 2A and 2B but illustrating the positional relationship of the retrievable landing assembly after the setting tool is released by rotation.
Figure 3B:
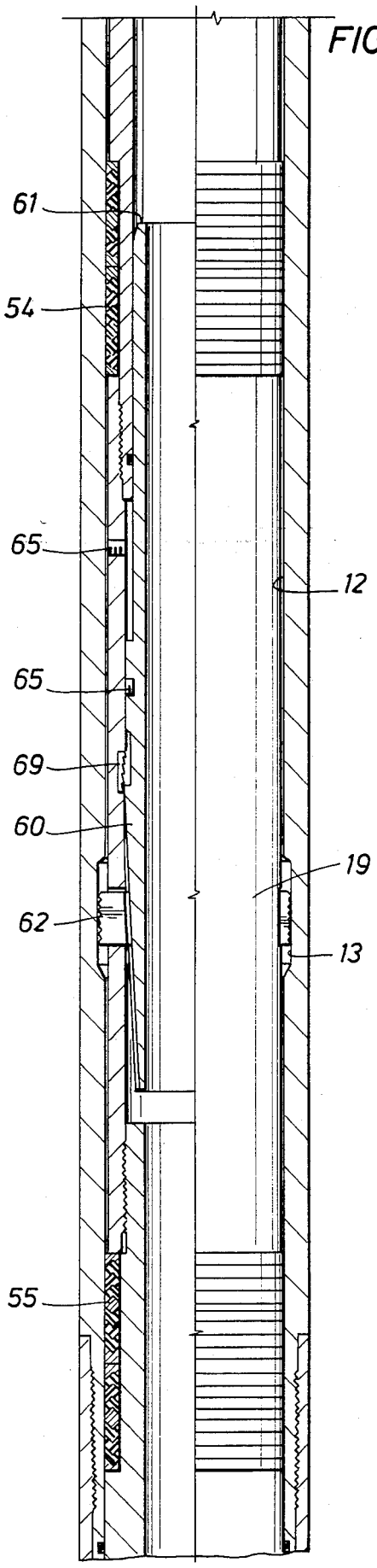

To release the setting unit 18 from the latching unit 19, from the position as shown in the FIGS. 2A and 2B, rotation of the mandrel 21 will cause the traveling nut 32 to disengage the setting unit 18 from the setting collar 30. Rotation of the mandrel 21 is obtained by rotating the tubing at the earth's surface, the tubing being connected to the sub 20. Thus, as shown in FIGS. 3A and 3B, the nut 32 is then released from the threaded portion 29 of the setting collar 30 and permits the setting unit 18 to be raised upwardly. Upon upward movement of the string of tubing, the flange 48 engages the flange 45 on the sleeve 46 which enables the mandrel 21 and pressure sleeve 46 to be retrieved leaving the retrievable landing unit 19 locked into the PBR 10 where the bore 12 is sealed by the packing elements 54 and 55.

Figure 4A:
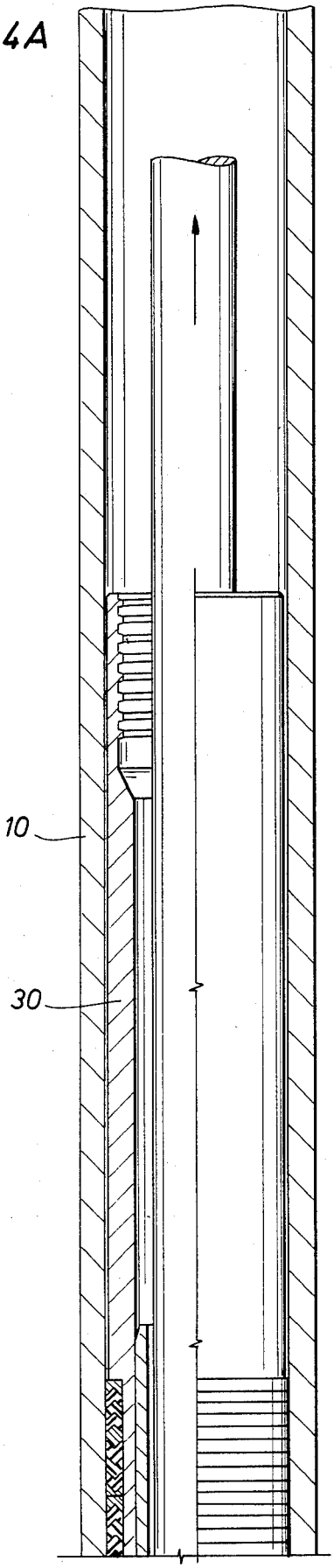
FIGS. 4A and 4B are views similar to FIGS. 3A and 3B but showing the positional relationship of the retrievable landing assembly in connection with a retrieving spear which has disengaged the assembly from the PBR by retracting the latch means from the latching groove in the packer bore receptacle.
Figure 4B:
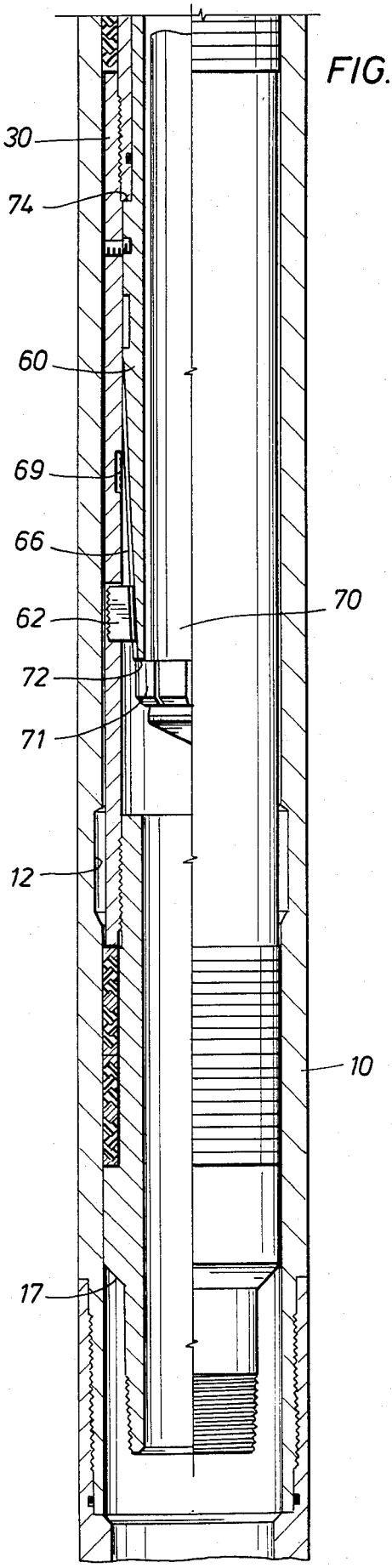

Thereafter, when it is desired to retrieve the retrievable landing unit 19, as shown in FIGS. 4A and 4B, a conventional retrieving tool or spear 70 may be lowered on a string of pipe until latching fingers 71 on the tool engage the lower end of the setting collar 60. Upon upward movement of the spear 70, the latching recess 68 shears the latch ring 69 in the recess 68 so that the latch elements 62 are retracted from the latching groove 13 permitting the tool unit to be retrieved.

In the operation of the system, a retrievable landing assembly or latching unit 19 is attached to a hydraulic setting tool 18 and lowered through the string of casing on a string of tubing until the assembly 19 engages the stop or landing seat 15 at which time the locking elements 62 are disposed adjacent to the locking groove 13. The ball 52 is dropped into the tubing string and hydraulic pressure applied to the tubing string. The hydraulic pressure shifts the sleeves 46 and 60 downwardly so that the shear pin 65 (FIG. 2B) is sheared at a predetermined pressure and the latching elements 62 are extended or moved outwardly by the tapered surface 66 into the locking groove 13. When the latching elements 62 are fully extended, the split ratchet ring 69 has locking teeth which engage the ratchet recess 70 and retain the sleeve 60 in a downward position with respect to the setting collar 30. A simple pull up on the tubing can determine if the latching elements have indeed latched into locking groove 13.

The tubing attached to the sub 20 is rotated next to the right which permits the traveling nut 32 to be rotated with the mandrel 21 relative to the setting collar 30. The nut 32 is rotated out of threaded engagement with the setting collar (FIG. 3A) and the setting unit 18, mandrel 21 and pressure sleeve 46 are withdrawn from the setting collar 30 leaving a landing assembly releasably latched in the polished bore of the PBR 10. As this setting equipment is withdrawn, the port 44 in the mandrel 21 allows fluid to drain out so that the tubing string is not retrieved full of fluid.

Should it become necessary to re-enter the lower part of the well the retrievable landing unit 19 is completely retrievable, as previously described, leaving the full internal bore of the casing open to use workover tools.

Figure 8A:
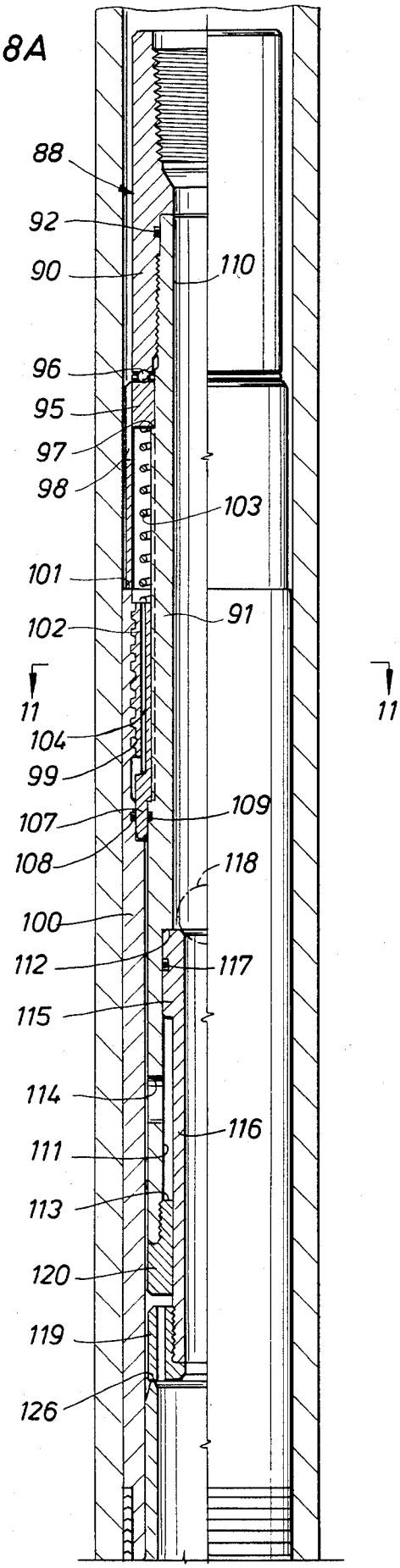
FIGS. 8A and 8B are views in longitudinal cross-section similar to FIGS. 1A and 1B but illustrating a preferred form of the invention.

Referring now to FIGS. 8A through 12B, another and preferred embodiment of the present invention is illustrated. As shown in FIGS. 8A and 8B, a Packer Bore Receptacle ("PBR") 80 is threadably connected at its lower end to a PBR Sub 81 which, in turn, is threadably connected to a conventional liner hanger (not shown). The PBR 80 is tubular with a uniform internal bore 82 along its length. Near the lower end of the internal bore 82 (FIG. 1B) is an annular landing groove or recess 83. The lower end of the PBR 80 has a fluid tight coupling with a PBR sub 81 by virture of an O-ring. The PBR sub 81 has an bore 84 which is smaller in diameter than bore 82 and the bores 82 and 84 are joined by a conical, upwardly facing surface which defines a landing seat or "No-Go" shoulder 85. The retrievable landing assembly ("RLA") 86 of this embodiment of the present invention is designed to pass through the bore 82 of the PBR 80 until a lower, downwardly facing, tapered shoulder surface 87 on the nose of the RLA 80 engages the landing seat or shoulder 85 in the PBR sub 81.

The Retrievable Landing Assembly 86 includes an upper hydraulic setting unit 88 which is releasably attached to a retrievable latching unit 89. The hydraulic setting unit 88 includes an upper tubular sub 90 which is threadably and sealingly coupled to a downwardly extending tubular mandrel 91. An O-ring seal 92 is disposed between the mandrel 92 and sub 90 to provide a fluid tight seal. The tubular mandrel 91 at its outer, upper end carries a rotatably mounted tubular cage member 95. The cage member 95 is rotatably mounted on the outer surface of the mandrel 91 between an annular ball bearing unit 96 and an upwardly facing shoulder 97 on the mandrel 91. Fluid pressure relief ports 98 are provided in the side wall of the cage member 95 to bypass fluid. The downwardly facing end of the cage member 95 engages the upwardly facing end of a tubular setting collar 100 on the latching unit 89 at a location designated by the number 101. The tubular setting collar 100 of the latching unit 89, at its upper end, has an interior threaded portion 99, which threadably engages a traveling nut 102 on the setting unit 98. In the setting unit 98, a compression spring 103 is disposed between the upper end of the traveling nut 102 and the cage member 95 to assist in assembly by forcing the nut 102 out from within the cage member 95. The traveling nut 102 has longitudinally extending bypass ports 104 as a fluid relief bypass and has internal longitudinally extending flat surfaces 105 (See FIG. 11) which engage with external longitudinally extending flat surfaces 106 on the outer surface of the mandrel 91.

The bottom of the traveling nut 102 has a tubular extension or valve part 107 which sealingly contacts O-rings 108 and 109 respectively in the setting collar 100 and the mandrel 91 to provide a fluid tight seal between the setting collar 100 and the mandrel 91. When the mandrel 91 of the setting unit 98 is rotated, the traveling nut 102 will be rotated relative to the setting collar 100 of the latching unit 98 so that the nut 102 can move longitudinally upward with respect to the mandrel 91. Upward movement first disengages the O-ring seals 108 and 109 from the valve part 107 and further upward movement disengages the nut 102 from the setting collar 100. The nut 102 thus serves both as a pressure valve and a releasable connection between the setting tool unit 88 and the retrievable latching unit 89, as will hereinafter be more fully apparent.

The mandrel 91 has a smooth interior bore 110 at its upper end and has an internal recess 111 along its length, the recess 111 being defined between upper and lower shoulders 112 and 113. The recess 111 is provided with a bypass relief port 114 for a fluid bypass when the unit is retrieved. Slidably and sealingly received in the internal recess 111 is an outwardly entending flange 115 on a pressure sleeve 116. An O-ring 117 is provided for sealing the flange 115 with respect to the bore 110 of the mandrel 91. Thus, the pressure sleeve 116 may move downwardly with respect to the mandrel 91 when a sealing ball 118 (shown in dashed line) is dropped down the tubing string and seated in the cross-sectional opening of the pressure sleeve 116 and pressure is applied.

At the lower end of the pressure sleeve 116 is an outwardly extending flange 119 which has vertical fluid bypass ports. The outwardly entending flange 119 is located below the lower end 120 of the mandrel 91.

Figure 8B:
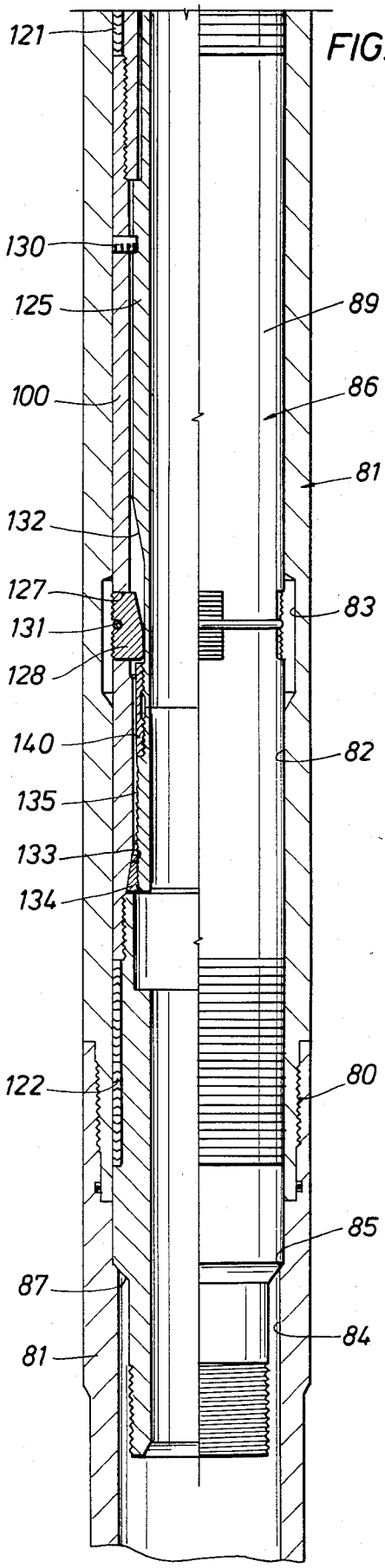

The setting collar 100 of the latching unit 89 (which is releasably coupled to the setting unit 88) has an external packing member 121 (FIG. 8A) and packing member 122 (FIG. 8B) for sealing and sliding reception within the bore 82 of the PBR 80 when the shoulder 87 is seated on the landing seat 85 (FIG. 8B). A tubular setting sleeve 125 (FIG. 8B) is slidably received within the setting collar 100 and, in an uppermost position, the upper end 126 of the sleeve 125 bears against the lower end of the flange 119 of the setting sleeve 116 (FIG. 8A). Between the upper and lower packing means 121 and 122, when the retrievable landing unit 89 is seated on the shoulder 85, there are circumferentially spaced openings 127 in the setting sleeve 125 which are disposed adjacent to the annular locking groove 83 in the PBR 80. Rectangularly shaped latching elements 128 with exterior griping teeth are disposed within the spaced openings 127 so as to move inwardly and outwardly with respect to the setting collar 100 and thus, into and out of annular locking groove 83 in the PBR 80. The setting sleeve 125 and the setting collar 100 are normally releasably coupled to one another by shear pin means 130. The latching elements 128 are retained in a retracted position by an annular resilient spring 131. The setting sleeve 125 has a tapered bowl 132 which, upon downward movement of the setting sleeve 125 with respect to the setting collar 100, will wedge or cam the locking elements 128 positively into engagement with the locking groove 83 (See FIG. 9). To retain the setting sleeve 125 in a downward locked position with respect to latching elements 128, the setting collar 100 is provided with an internal tapered recess 133 which carries a split, ratchet ring 134. The ratchet ring 134 has an outer tapered section which cooperates with the tapered recess 133 and an inner serrated tooth section which is arranged to engage a ratchet 135 on the sleeve 125. Upon downward movement of the setting sleeve 125 after the shear pin 130 is sheared at a predetermined pressure range, the ratchet 135 slides through the ring 134 but upward return travel of the sleeve is prevented. Thus engagement of the ratchet ring 134 and the ratchet 135 prevent return motion of the setting sleeve 125 and retain the latching elements 128 in a mechanically locked position (See FIG. 9).

Figure 9:
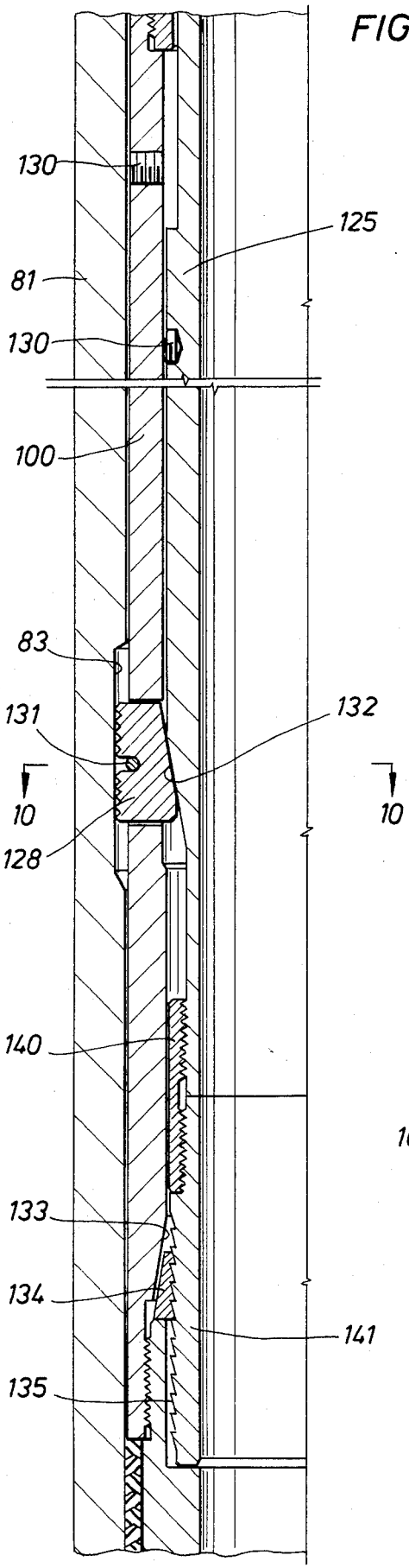
FIG. 9 is a view in longitudinal partial cross-section illustrating the latching and release mechanisms of FIG. 8B in enlarged view.
Figure 10:
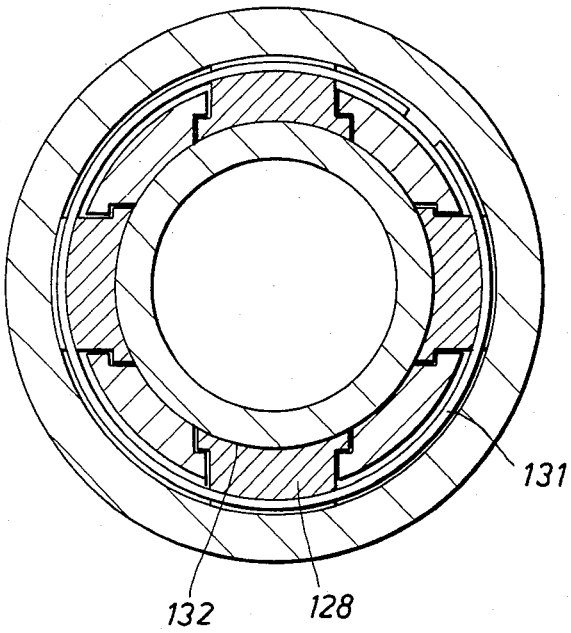
FIG. 10 is a view in cross-section taken along line 10—10 of FIG. 9.
Figure 11:
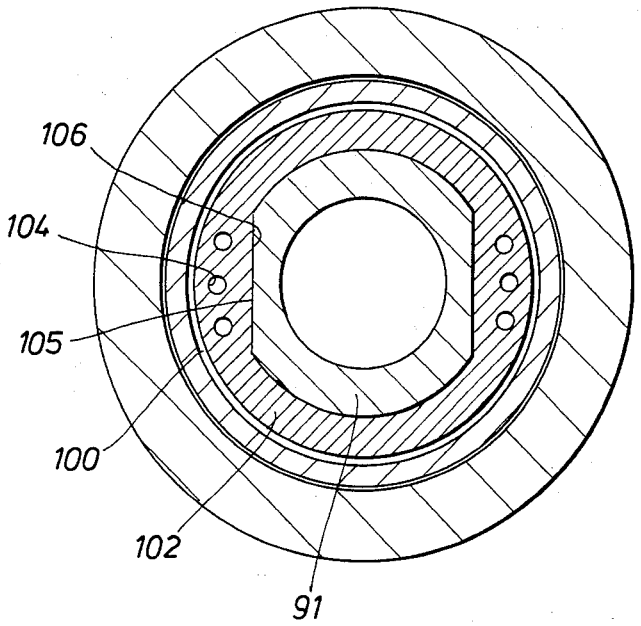
FIG. 11 is a view in cross-section taken along line 11—11 of FIG. 8A.

Referring now to FIG. 8A, as shown in enlarged detail in FIG. 9, the setting collar 125 is attached by a threaded shear coupling 140 to a ratchet sub 141 which contains the external ratchet 135. The shear coupling 140 is adopted to shear upon the application of a predetermined force to release the setting collar 125 from the ratchet and thereby permits release of the latching elements 128. The tool is illustrated in position where a sealing ball 118 is located across the bore of the pressure sleeve 116 so that hydraulic pressure applied within the tubing can move the pressure sleeve 116 downwardly and break the shear pins 130. In the downward movement of pressure sleeve 116, the latching elements 128 are wedged outwardly into engagement with the annular groove 83 and the ratchet ring 134 engages the ratchet 135 to lock the setting sleeve 125 in its downward position.

To release the setting unit 88 from the latching unit 89, rotation of the mandrel 91 will cause the traveling nut 102 to disengage the setting unit 88 from the setting collar 100. The rotation of the mandrel 91 is produced by rotating the tubing at the earth's surface, the tubing being connected to the sub 90. Thus, the nut 102 is released from the threaded portion 99 of the setting collar 100 and permits the setting unit 88 to be raised upwardly. Upon upward movement of the string of tubing, the shoulder 113 engages the flange 115 on the sleeve 116 and the mandrel 91 and pressure sleeve 116 are retrieved leaving the retrievable landing unit 89 locked into the PBR 80 where the bore 82 is sealed by the packing elements 121 and 122.

Figure 12A:
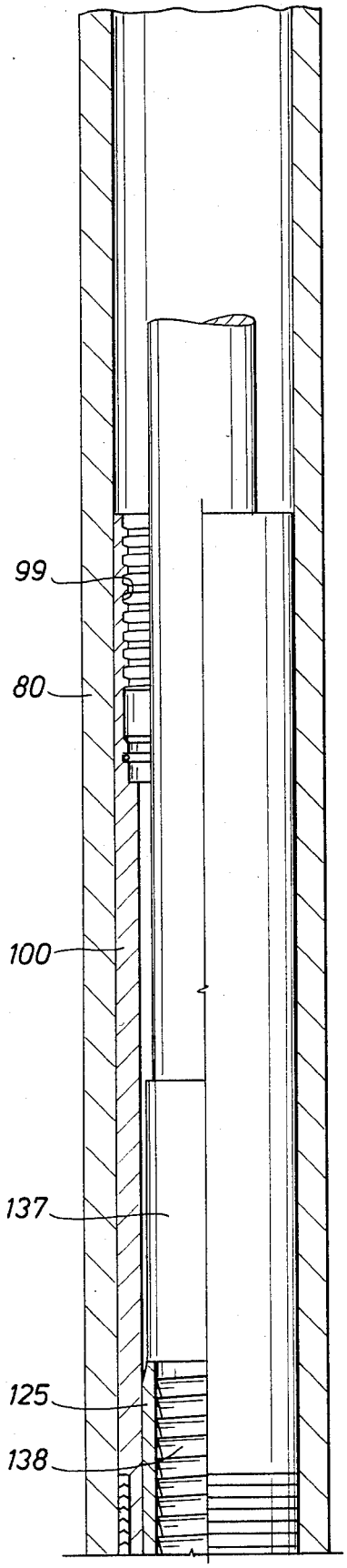
FIGS. 12A and 12 are views in longitudinal cross-section similar to FIGS. 4A and 4B in showing the relationship of the tool in respect to a retrieving spear.
Figure 12B:
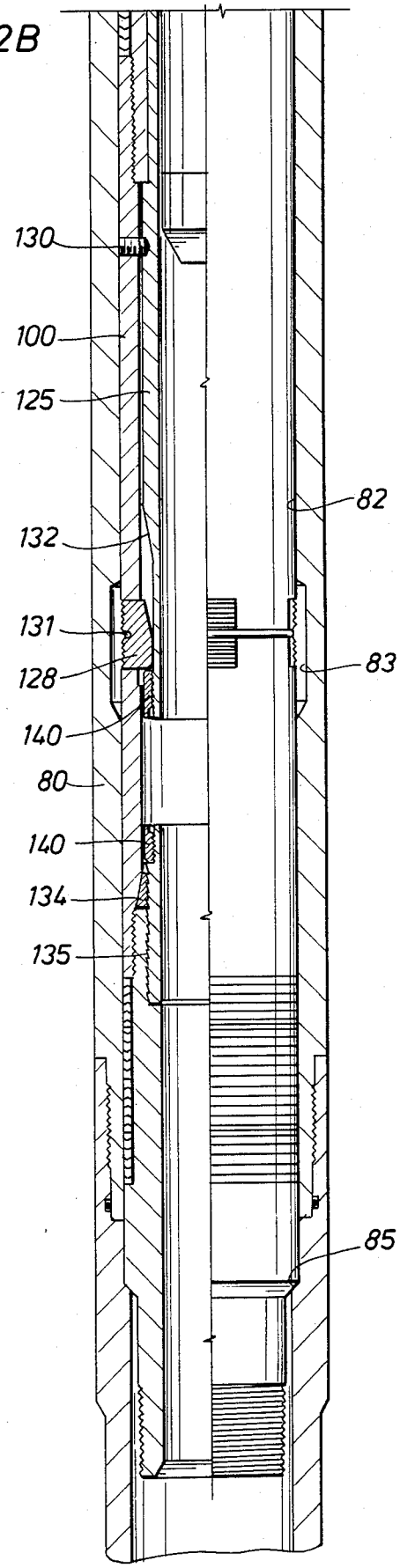

Thereafter, when it is desired to retrieve the retrievable landing assembly 89 as shown in FIGS. 12A and 12B, a conventional retrieving tool or spear 137 may be lowered on a string of pipe until a spiral grapple 138 on the spear 137 engages the lower end of the setting sleeve 125. Upon upward movement of the spear 137, the shear coupling 140 shears to release the setting sleeve 125 and the latching elements 128 are retracted from the latching groove 83 thereby permitting the tool to be retrieved.

In the operation of the system, as illustrated in FIGS. 8–12, a retrievable landing assembly or latching unit 89 is attached to a hydraulic setting tool 88 and lowered through the string of casing on a string of tubing until the assembly 89 engages the stop or landing seat 85 in the PBR 80 at which time the locking elements 128 are disposed adjacent to the locking groove 83. Hydraulic pressure is then applied to the tubing string. If the retrievable landing unit 89 is properly seated in the PBR then there will be a pressure build-up which can be detected. The pressure build-up indicates proper sealing and seating of the RLA in the PBR. If there is improper location of the tool then no pressure build-up will occur. Thus there is a position indication of the proper location of the tool. If there is proper seating of the RLA in the PBR, the tubing string is rotated to the right to open the valve by removing the valve part 107 from the seals 108 and 109. Next, the ball 18 is dropped into the tubing string and hydraulic pressure applied to the tubing string at this time to activate the setting mechanism. The hydraulic pressure shifts the sleeves 116 and 125 downwardly so that the shear pin 130 (FIG. 8B) is sheared at a predetermined pressure and the latching elements 128 are extended or moved outwardly by the tapered surface 132 into the locking groove 83. When the latching elements 128 are fully extended, the split ratchet ring 134 has locking teeth which engage the mating ratchet teeth 135 and retain the sleeve 125 in a downward locked position with respect to the setting collar 100. A simple pull up on the tubing can determine if the latching elements 134 have latched into locking grooves 83.

The tubing attached to the sub 90 is then rotated to the right which permits the traveling nut 102 to be rotated with the mandrel 91 relative to the setting collar 100. The nut 102 is rotated out of threaded engagement with the setting collar 100 and the setting unit 88, the mandrel 91 and the pressure sleeve 116 are withdrawn from the setting collar 100 leaving a landing assembly releasably latched in the production bore of the PBR 80. As this setting equipment is withdrawn, the port 114 in the mandrel 91 allows fluid to drain out so that the tubing string is not retrieved full of fluid.

Should it become necessary to re-enter the lower part of the well the RLA 86 is completely retrievable, as previously described, leaving the full internal bore of the casing open to use workover tools.

While various embodiments are illustrated, the scope of the invention is included within the claims which follow.

I claim:

1. A method of setting a retrievable landing assembly in a packer bore receptacle in a well bore comprising the steps of:

lowering a retrievable landing assembly and setting tool on a string of tubing through a string of pipe containing a packer bore receptacle until the retrievable landing assembly is sealingly received in the packer bore receptacle and is seated therein;

applying hydraulic pressure to said string of tubing to determine by a build-up of pressure that the retrievable landing assembly is properly seated in the packer bore receptacle, opening a valve in the setting tool to permit circulation of liquid between the setting tool and packer bore receptacle above the sealing elements on the packer bore receptacle and dropping a sealing ball through the tubing string to seal off the cross-section of the setting tool so that a setting force may be applied to the retrievable landing assembly;

applying hydraulic pressure to said tubing string after the ball is seated in the setting tool for actuating said setting tool and said retrievable landing assembly;

disconnecting said setting tool from the retrievable landing assembly after the actuation of the retrievable landing assembly and retrieving said setting tool.

2. The method as defined in claim 1 wherein, upon disconnection of the setting tool from the retrievable landing assembly, a fluid bypass is opened in said setting tool above the location of the sealing ball.

3. A retrievable landing assembly for use in a packer bore receptacle in a well bore where said packer bore receptacle has a polished bore, a landing seat and a latching groove disposed intermediate of the length of said polished bore, said retrievable landing assembly including:

a telescopically coupled setting sleeve and setting collar, said setting collar having a lower downwardly facing seating surface for engagement with an upwardly facing landing seat in a packer bore receptacle;

said setting collar having latching means which are radially movable between extended and retracted positions relative to said setting collar, said latching means being responsive to longitudinal movement of said setting sleeve so that in one longitudinal telescopic position of said setting sleeve, said latching means are retracted and in another longitudinal telescopic position of said setting sleeve, said latching means are extended into a locking relationship with a latching groove in a packer bore receptacle;

release means for releasably interconnecting said setting sleeve and setting collar in one of said longitudinal positions to retain said latching means in an extended position;

hydraulically operated setting tool means;

release means on said setting tool means for releasably coupling said setting tool means to said setting collar and operative upon rotation to release said setting tool means relative to said setting collar; and actuating means in said setting tool means adapted for response to hydraulic pressure for moving said setting sleeve between said one longitudinal telescopic position and said other longitudinal telescopic position.

4. The retrievable landing assembly as defined in claim 3 wherein said actuating means is a sleeve member slidable and sealingly received in a tubular housing mandrel for movement between an upper location and a lower location relative to said housing mandrel, said housing mandrel having bypass ports which are closed off when said sleeve member is in an upper location and which are open when said sleeve member is in a lower location.

5. The retrievable landing assembly as defined in claim 4 wherein said release means includes an internal threaded portion on the setting collar and a nut means threadedly received in said setting collar, said nut means being slidably and non-rotatively mounted on said housing mandrel whereby upon relative rotation between said housing mandrel and setting collar that said nut means may be disengaged from said setting collar.

6. The retrievable landing assembly as defined in claim 5 wherein said release means includes a tubular cage member rotatively mounted on said housing mandrel to engage the upper end of said setting collar, said cage member having an internal recess sized to receive said nut means upon relative rotation between said housing mandrel and setting collar.

7. The retrievable landing assembly as defined in claim 3 wherein said release means includes an annular ratchet ring on one of said setting collar and said setting sleeve for retaining said setting sleeve and setting collar in a longitudinal telescopic position when said latching means are extended in their locking relationship.

8. The retrievable landing assembly as defined in claim 7 wherein said release means include a frangible sleeve element which will separate to release said setting sleeve from said setting collar upon a predetermined force being applied to said setting sleeve.

9. The retrievable landing assembly as defined in claim 8 wherein said shear element comprises a shear coupling disposed above said release means.

10. A retrievable landing assembly for use in a packer bore receptacle having a polished sealing bore with a latching groove intermediate of the length of said sealing bore and a lower upwardly facing landing seat including:

a telescopic setting sleeve and setting collar sized to be slidingly and sealingly received within a sealing bore of a packer bore receptacle, said setting collar having a downwardly facing seating surface for engagement with a landing seat in a packer bore receptacle, means for releasably latching and unlatching said setting sleeve with respect to a packer bore receptacle in response to longitudinal movement of said setting sleeve with respect to said setting collar;

setting tool means sized for passage through a packer bore receptacle, release means releasably coupling said setting tool means to said setting collar, said setting tool having a slidable pressure sleeve within a housing mandrel so that said pressure sleeve disposed in engagement with said setting sleeve when said setting tool is connected to said setting collar;

said setting tool means having means for providing a fluid tight passage to said pressure sleeve whereby hydraulic pressure may be applied to said pressure sleeve for moving said setting sleeve relative to said setting collar and thereby setting said latching means.

11. The retrievable landing assembly as defined in claim 10 wherein said release means on said setting tool defines a normally closed valve means with respect to the interconnection of said setting collar and said housing mandrel, said valve means being opened by partial operation of said release means.

12. A setting tool for a retreivable landing assembly for use in a packer bore receptacle comprising:

a tubular housing mandrel adapted for coupling with a string of tubing, said housing mandrel having a tubular cage member rotatably mounted on said housing;

a nut member splined to said housing mandrel for longitudinal movement and non-rotative below said tubular cage member, said nut member having an external thread for coupling with a housing on a retrievable landing assembly;

spring means disposed in compression between said cage member and nut member;

a tubular hydraulic pressure sleeve sealingly and slidably mounted within the bore of said housing mandrel, said pressure sleeve having its lower end adapted to engage the setting mechanism on a retreivable landing assembly and having an upper end adapted to receive a sealing ball.

13. The setting tool as defined in claim 12 wherein said nut member has a downwardly projecting, annular valve member adapted to cooperate with said housing mandrel and a housing on a retreivable landing assembly to selectively close off the flow passage therebetween.

14. A retrievable landing assembly for use in a packer bore receptacle in a well bore where said packer bore receptacle has a polished bore, a landing seat and a latching groove disposed intermediate of the length of said polished bore, said retrievable landing assembly including:

a telescopically coupled setting sleeve and setting collar; said setting collar having a lower downwardly facing seating surface for engagement with an upwardly facing landing seat in a packer bore receptacle and having sealing means for sealing in a polished bore of a packer bore receptacle;

said setting collar having normally retracted latching means which are radially movable between a retracted and an extended position relative to said setting collar, said latching means being responsive to longitudinal movement of said setting sleeve so that in one longitudinal telescopic position of said setting sleeve said latching means are retracted and in another longitudinal telescopic position of said setting sleeve, said latching means are extended into a locking relationship with a latching groove in a packer bore receptacle;

hydraulically operated setting means releasably coupled to said setting collar and setting sleeve for producing longitudinal movement between said setting collar and setting sleeve;

release means for releasably interconnecting said setting sleeve and setting collar in a longitudinal position when said latching means are in an extended position, said release means being operable upon the application of a predetermined force to permit movement of said setting sleeve relative to said setting collar for permitting retraction of said latching means.

15. The retrievable landing assembly as defined in claim 14 and further including valve means in said setting means, said valve means being operable for testing whether or not said retrievable landing assembly is sealingly received in a packer bore assembly.

16. A method of setting a retrievable landing assembly in a packer bore receptacle disposed within a well bore comprising the steps of:

lowering a retrievable landing assembly and setting tool on a string of tubing through a string of pipe in which a packer bore receptacle is previously located;

positioning the retrievable landing assembly in sealingly reception within such packer bore receptacle and in a seated relationship to such packer bore receptacle;

applying pressure to said string of tubing to determine by a build-up of pressure that the retrievable landing assembly is properly seated in the packer bore receptacle;

opening a bypass in the tool to permit circulation of liquid between the setting tool and packer bore receptacle;

sealing off the cross-section of the setting tool below the bypass so that a pressure may be applied to the setting tool through the tubing string;

applying pressure to said tubing string after sealing off the cross-section of the setting tool for operating a retracted latching means in said retrievable landing assembly and for extending said latching means and latching said retrievable latching assembly to such packer bore receptacle in a string of pipe;

disconnecting said setting tool from the retrievable landing assembly after latching the retrievable landing assembly in such packer bore receptacle; and retrieving said setting tool leaving the retrievable landing assembly latched to the packer bore receptacle in the string of pipe.

17. A method of setting a retrievable landing assembly in a packer bore receptacle disposed within a well bore comprising the steps of:

lowering a retrievable landing assembly and setting tool on a string of tubing through a string of pipe in which a packer bore receptacle is previously located;

positioning the retrievable landing assembly with a sealing element in sealing reception within said packer bore receptacle and in a seated relationship to such packer bore receptacle;

sealing off the cross-section of the setting tool so that a pressure may be applied to the setting tool through the tubing string;

applying pressure to said tubing string after sealing off the cross-section of the setting tool for producing a force on retracted latching means in said retrievable landing assembly to positively move the latching means from a retracted to an extended position thereby latching said retrievable landing assembly to such packer bore receptacle in a string of pipe;

disconnecting said setting tool from the retrievable landing assembly after latching the retrievable landing assembly in such packer bore receptacle; and retrieving said setting tool leaving the retrievable landing assembly latched to the packer bore receptacle in the string of pipe.

18. The method as defined in claim 17 wherein, the disconnecting of the setting tool includes relieving of pressure in said tubing string by opening a fluid bypass in said setting tool above the location of the sealing element upon disconnection of the setting tool from the retrievable landing assembly.

* * * * *